US008876253B2

(12) United States Patent
Iesaki

(10) Patent No.: US 8,876,253 B2
(45) Date of Patent: Nov. 4, 2014

(54) IMAGE RECORDING APPARATUS

(71) Applicant: Kenichi Iesaki, Ichinomiya (JP)

(72) Inventor: Kenichi Iesaki, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 28 days.

(21) Appl. No.: 13/847,777

(22) Filed: Mar. 20, 2013

(65) Prior Publication Data

US 2013/0257983 A1 Oct. 3, 2013

(30) Foreign Application Priority Data

Mar. 30, 2012 (JP) ..... 2012-079797

(51) Int. Cl.
*B41J 23/00* (2006.01)
*B41J 25/00* (2006.01)
*B41J 19/20* (2006.01)

(52) U.S. Cl.
CPC ..... *B41J 25/001* (2013.01); *B41J 19/202* (2013.01)
USPC ..... 347/37

(58) Field of Classification Search
CPC ..... B41J 25/001; B41J 19/202
USPC ..... 347/20, 37, 84–87
See application file for complete search history.

(56) References Cited

U.S. PATENT DOCUMENTS

| | | | | |
|---|---|---|---|---|
| 7,547,091 | B2 * | 6/2009 | Hashii et al. | 347/37 |
| 8,201,929 | B2 | 6/2012 | Sugahara et al. | |
| 2007/0046716 | A1 | 3/2007 | Ishikawa | |
| 2009/0267986 | A1 | 10/2009 | Sugahara et al. | |

FOREIGN PATENT DOCUMENTS

| | | | |
|---|---|---|---|
| JP | 01-320511 | A | 12/1989 |
| JP | 2005-262773 | A | 9/2005 |
| JP | 2007-090875 | A | 4/2007 |
| JP | 2009-286115 | A | 12/2009 |

* cited by examiner

*Primary Examiner* — Juanita D Jackson
(74) *Attorney, Agent, or Firm* — Banner & Witcoff, Ltd.

(57) ABSTRACT

An image recording apparatus includes a carriage which moves in a main scanning direction, a recording head which is installed on the carriage, and which records an image on a sheet, a drive section which has a motor, and which applies a driving force to the carriage, a guide member which guides the carriage in the main scanning direction, a first contact portion which is provided to the carriage and which contacts with the guide member, a second contact portion which is provided to sandwich a center of gravity of the carriage between the first contact portion and the second contact portion and which contacts with the guide member, and a friction-force adjusting section which adjusts a friction force acting between the guide member and the first contact portion in accordance with an acceleration of the carriage.

14 Claims, 10 Drawing Sheets

IMAGE RECORDING APPARATUS

CROSS REFERENCE TO RELATED APPLICATION

The present invention claims priority from Japanese Patent Application No. 2012-079797, filed on Mar. 30, 2012, the disclosure of which is incorporated herein by reference in its entirety.

BACKGROUND OF THE INVENTION

1. Field of the Invention

The present invention relates to an image recording apparatus, in which a recording head installed on a carriage records an image on a sheet, while the carriage is moving.

2. Description of the Related Art

An image recording apparatus, in which a recording head records an image on a sheet while moving along a sheet, has hitherto been known. The recording head is installed on a carriage, and the carriage moves in a main scanning direction which is orthogonal to a direction in which the sheet is transported. While the carriage is moving, the recording head records an image on the sheet. An ink-jet printer can be cited as an example of the image recording apparatus of the above-mentioned type.

An image forming apparatus, which includes: a gyro sensor for detecting rotation of the carriage; and a sliding protrusion for suppressing the change in a posture of the carriage by being contacted with a guide piece when the gyro sensor has detected the rotation, can be cited as an example of a heretofore known technology.

SUMMARY OF THE INVENTION

In the heretofore known technology, the sliding protrusion contacts with the guide piece by the detection of the rotation by the gyro sensor. In other words, an effect of suppressing the change in posture of the carriage is exerted only after the posture of the carriage has changed. For carrying out highly accurate image recording, it is necessary to suppress the change in the posture of the carriage.

The present invention has been made in view of the above-mentioned problem, and an object of the present invention is to provide an image recording apparatus which is possible to suppress the change in the posture of the carriage.

According to an aspect of the present invention, there is provided an image recording apparatus configured to record an image on a sheet, including: a carriage configured to move in a main scanning direction; a recording head installed on the carriage and configured to record the image on the sheet; a drive section having a motor and configured to apply a driving force to the carriage; a guide member configured to guide the carriage in the main scanning direction; a first contact portion provided to the carriage and configured to contact with the guide member; a second contact portion provided to sandwich a center of gravity of the carriage between the first contact portion and the second contact portion and configured to contact with the guide member; and a friction-force adjusting section configured to adjust a dynamic friction force acting between the guide member and the first contact portion in accordance with an acceleration of the carriage.

According to an arrangement in the present invention, since the dynamic friction force acting between the guide member and the first contact portion is adjusted in accordance with the acceleration of the carriage, it is possible to suppress a generation of a rotational moment which changes a posture of the carriage. In other words, it is possible to suppress the change in the posture of the carriage in advance.

BRIEF DESCRIPTION OF THE DRAWINGS

FIG. 9A shows a state in which the carriage moves upward and decelerates, FIG. 9B shows a state in which the carriage moves downward and accelerates, and FIG. 9C shows a state in which the carriage moves downward and decelerates.

DETAILED DESCRIPTION OF THE PREFERRED EMBODIMENTS

Figure 1:
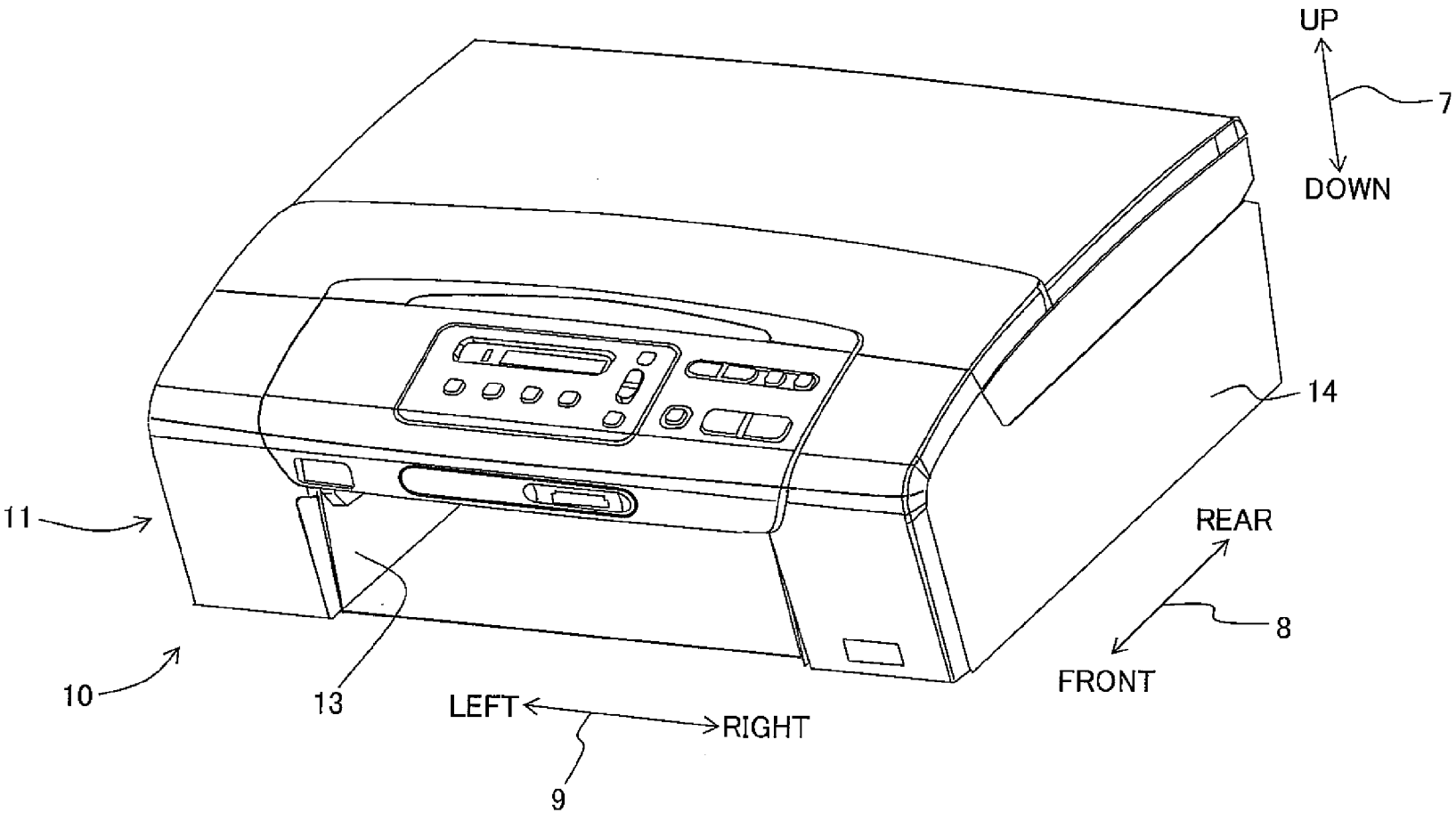
FIG. 1 is a perspective view of a multi-function device according to an embodiment of the present invention.

An embodiment of the present invention will be described below by referring to the accompanying diagrams. However, the embodiment described below is merely an example of the present invention, and it is needless to mention that various modifications can be made appropriately in the embodiment of the present invention without departing from the scope of the invention. A multi-function device 10 is used upon setting to a state shown in FIG. 1. In the embodiment, three directions which are shown by assigning arrows are a vertical direction 7, a frontward-rearward direction 8, and a left-right direction 9. Moreover, in the following description, the vertical direction 7 is defined upon letting a state in which, the multi-function device 10 is usably installed (state in FIG. 1) to be a standard, the frontward-rearward direction 8 is defined upon letting a side on which an opening 13 is provided to be a frontward side (front), and the left-right direction 9 is defined upon viewing the multi-function device 10 from the frontward side (front).

As shown in FIG. 1, the multi-function device 10 (an example of an image recording apparatus according to the present invention) is formed to be a thin rectangular parallelepiped shape, and a printer section 11 of an ink jet recording type is provided at a lower portion thereof. The multi-function device 10 has a print function of recording an image on a recording paper 21 (FIG. 2, an example of a sheet according to the present invention). The printer section 11 has a casing 14 in a front surface of which the opening 13 is formed, and a tray 20 in which, the recording papers 21 of various sizes are placed (FIG. 2) can be inserted in and drawn out form the opening 13, in the frontward-rearward direction 8.

<Arrangement in Printer Section 11>

Figure 2:
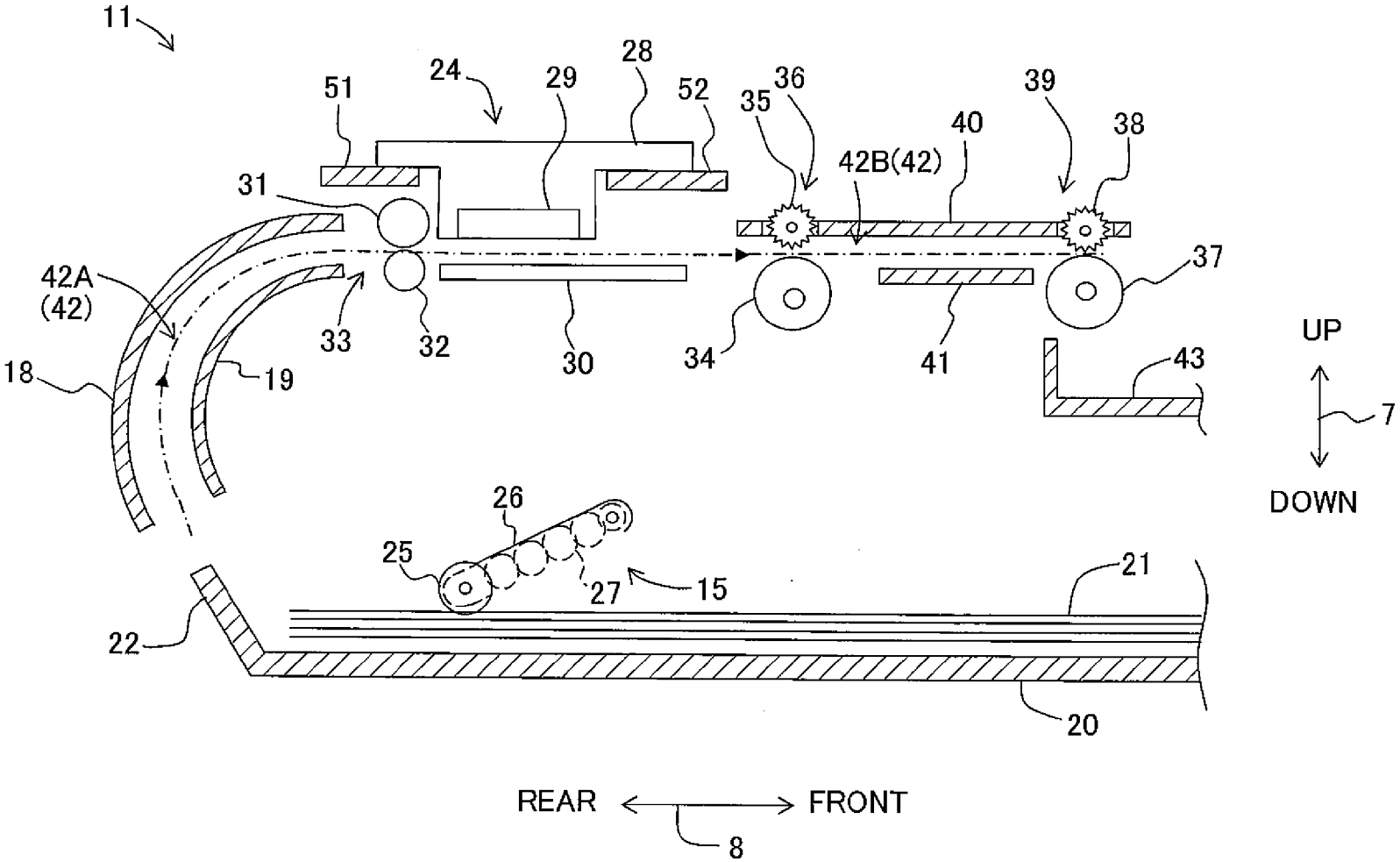
FIG. 2 is a schematic diagram showing a structure of a printer section.

As shown in FIG. 2, the printer section 11 includes a paper feeding section 15 and a recording section 24. The paper feeding section 15 picks up the recording paper 21 from the tray 20, and feeds. The recording section 24 records an image on the recording paper 21 by jetting ink droplets on to the recording paper 21 which has been fed by the paper feeding section 15.

<Paper Feeding Section 15>

Figure 5:
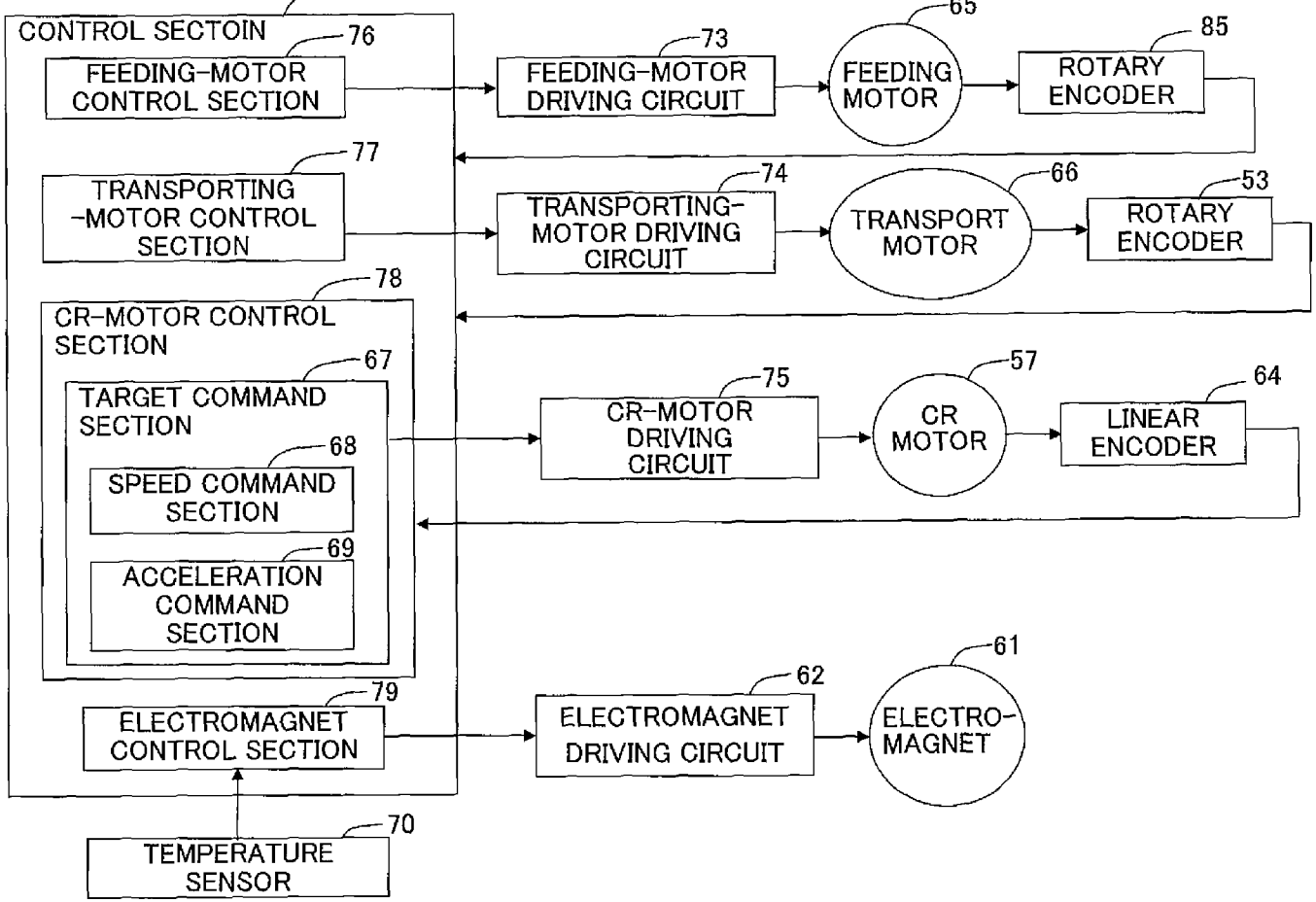
FIG. 5 is a block diagram showing a functional configuration of a control section.

As shown in FIG. 2, the paper feeding section 15 includes a paper feeding roller 25, a paper feeding arm 26, and a drive transmission mechanism 27. The paper feeding roller 25 rotates upon a driving force of a motor for feeding (hereinafter, "feeding motor") 65 (FIG. 5) being transmitted by the drive transmission mechanism 27 in which a plurality of gears is engaged. The drive transmission mechanism 27 is arranged inside the paper feeding arm 26. The paper feeding roller 25 supplies the recording paper 21 to a curved path 42A which will be described below.

<Transporting Path 42>

As shown in FIG. 2, a transporting channel 42 from a front end (an end portion at a rear side) of the tray 20 up to a discharged-paper holding portion 43 through the recording section 24 is formed at an interior of the printer section 11. The transporting path 42 is divided into the curved path 42A and a paper discharge path 42B. The curved path 42A is formed from the front end of the tray 20 up to the recording section 24. The paper discharge path 42B is formed from the recording section 24 up to the paper-discharge holding section 43.

The curved path 42A is a curved passage extended from an area near an upper end of an inclined portion 22 provided to the tray 20 all along up to the recording section 24. The curved path 42A is formed by an outer-side sheet guide 18 and an inner-side sheet guide 19 which are facing mutually, and are separated by a predetermined distance. The recording paper 21 which is fed from the tray 20 is bent along a transporting direction (a direction of an arrow indicated by an alternate long and short dash line in FIG. 2) of the curved path 42A, and is U-turned to advance frontward. The recording paper 21 which is U-turned is guided directly beneath the recording section 24. The outer-side sheet guide 18 and the inner-side sheet guide 19, and sheet guides 40 and 41 which will be described later, are extended in the left-right direction 9 (a direction perpendicular to a paper surface in FIG. 2).

The paper discharge path 42B is a straight passage extended from directly below the recording section 24 all along up to the discharged-paper holding portion 43. The paper discharge path 42B is formed by the recording section 24 and a platen 30 which are facing mutually, and are separated by a predetermined distance, at a location where the recording section 24 is provided. On the other hand, the paper discharge path 42B is formed by an upper-side sheet guide 40 and a lower-side sheet guide 41 which are facing mutually, and are separated by a predetermined distance, at a location where the recording section 24 is not provided. The recording paper 21 is guided in the transporting direction through the paper discharge path 42B.

<Transporting Rollers 31, 34, and 37>

As shown in FIG. 2, a first roller pair 33 which includes a first transporting roller 31 and a pinch roller 32 is provided at a downstream side in the transporting direction of the recording section 24. The pinch roller 32 makes a pressed contact with a surface of the first transporting roller 31 by an elastic member such as a spring which is not shown in the diagram. The first roller pair 33 pinches the recording paper 21 which has been fed through the curved path 42A, and sends to the recording section 24.

A second roller pair 36 which includes a second transporting roller 34 and a spur 35 is provided at an upstream side in the transporting direction of the platen 30. The spur 35 makes a pressed contact with a surface of the second transporting roller 34 by an elastic member such as a spring which is not shown in the diagram. The second roller pair 36 pinches the recording paper 21 having an image recorded thereon in the recording section 24, and sends to the downstream side of the transporting direction.

A third roller pair 39 which includes a third transporting roller 37 and a spur 38 is provided at a downstream side in the transporting direction of the second roller pair 36. The spur 38 makes a pressed contact with a surface of the third transporting roller 37 by an elastic member such as a spring which is not shown in the diagram. The third roller pair 39 pinches the recording paper 21 which has been transported by the second roller pair 36, and sends toward the discharged-paper holding portion 43.

A rotary encoder 53 of an optical type (FIG. 5) is provided in an area around the first transporting roller 31. The rotary encoder 53 detects rotation of the first transporting roller 31 and transmits a signal based on an amount of rotation (number of rotations) of the first transporting roller 31, to the control section 54.

<Recording Section 24>

Figure 3:
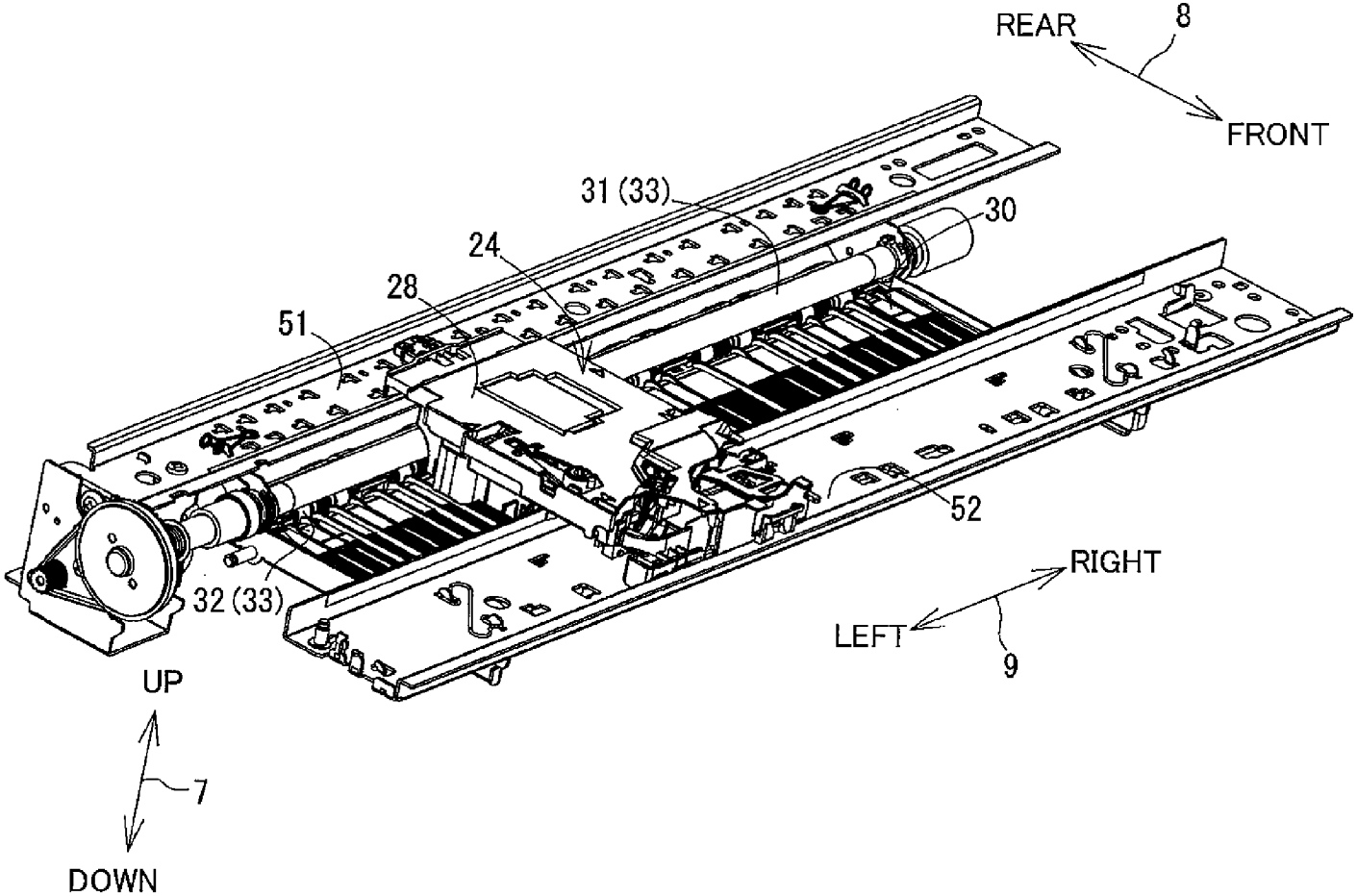
FIG. 3 is a perspective view showing a surrounding of a recording section.

As shown in FIG. 2, the recording section 24 includes a carriage 28, and a recording head 29 which has been installed on the carriage 28. Moreover, as shown in FIG. 3, the carriage 28 is supported by a first carriage guide 51 (an example of a first guide member) and a second carriage guide 52 (an example of a second guide member). The first carriage guide 51 and the second carriage guide 52 have a shape of a substantially flat plate which is thin vertically, with the left-right direction 9 as a longitudinal direction, and are provided to be isolated mutually in the frontward-rearward direction. Here, the first carriage guide 51 and the second carriage guide 52 combined together is an example of a guide member according to the present invention.

Figure 4:
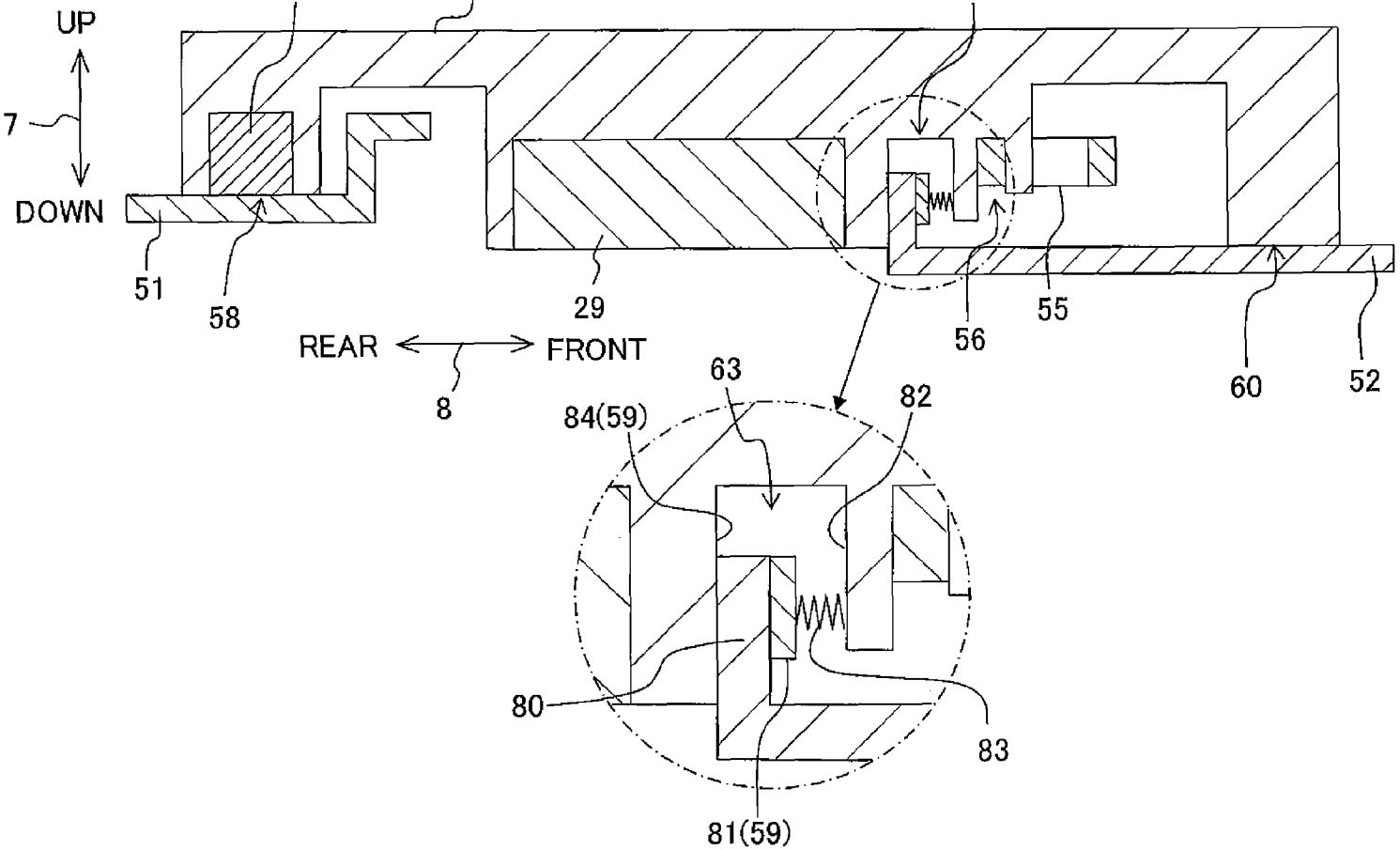
FIG. 4 is a cross-sectional view schematically showing a structure of a carriage.

Although it is not shown in FIG. 3, a timing belt 55 is extended all along the left-right direction 9, on an upper surface of the second carriage guide 52 (FIG. 4 and FIG. 6). The timing belt 55 is put around pulleys not shown in the diagram which are provided to be isolated in the left-right direction. A part of the timing belt 55 in the left-right direction 9 is fitted to a coupling portion 56 of the carriage 28 (FIG. 4 and FIG. 6). The coupling portion 56 is arranged on a front side of the carriage 28, than the recording head 29. The timing belt 55 is driven by a CR motor 57 (FIG. 5, an example of a motor according to the present invention) rotating the pulley, and a driving force is transmitted to the carriage 28 by the timing belt 55 being pulled.

As shown in FIG. 4, the carriage 28 includes a first contact portion 58 which contacts with the first carriage guide 51, and a second contact portion 59 and a third contact portion 60 which contact with the second carriage guide 52. The first contact portion 58 is provided to a rear-end side of the carriage 28, than the recording head 29. An electromagnet 61 is mounted on the carriage 28, in an area around the first contact portion 58. The electromagnet 61 is either exposed to a lower side of the carriage 28 or is covered by a material such as resin. The first contact portion 58 is formed on a portion around the electromagnet 61, and contacts with an upper surface of the first carriage guide 51 in the vertical direction 7. A voltage is applied to the electromagnet 61 by an electromagnet driving circuit 62 (FIG. 5), and the electromagnet 61 generates a magnetic field. The first carriage guide 51 being manufactured by using a ferromagnetic substance such as iron, the first contact portion 58 is attracted toward the first carriage guide 51 due to the magnetic field generated by the electromagnet 61.

A groove 63 having a lower side open along the left-right direction 9 is formed on a frontward side of a position on the carriage 28, at which the recording head 29 has been installed. An erected portion 80 which is erected upward is formed at a rear end of the second carriage guide 52, along the left-right direction 9. The erected portion 80 is inserted into the groove 63. A contacting piece 81 which contacts with the second carriage guide 52, and a spring member 83 which is arranged between the contacting piece 81 and a front-side wall 82 which forms the groove 63 and which applies bias to the contacting piece 81 to be pushed against the second carriage guide 52 are provided inside the groove 63. The erected portion 80 is sandwiched between the contacting piece 81 and a rear-side wall 84 forming the groove 63. The second contact portion 59 is formed by the contacting piece 81 and the rear-side wall 84 of the groove 63. The third contact portion 60 is provided at a front end of the carriage 28. The third contact portion 60 contacts with the upper surface of the second carriage guide 52. The abovementioned coupling portion 56 is provided between the second contact portion 59 and the third contact portion 60.

The carriage 28 is driven by being pulled by the timing belt 55. At this time, movement of the carriage 28 in the frontward-rearward direction 8 is regulated due to contact of the second contact portion 59 with the erected portion 80 of the second carriage guide 52. Moreover, movement of the carriage 28 in the vertical direction 7 is regulated due to contact of the first carriage guide 51 with the first contact portion 58, and contact of the third contact portion 60 with the second carriage guide 52. The carriage 28 while being regulated in such manner, is guided in the left-right direction 9. Here, a combination of the CR motor 57, the pulleys, and the time belt 55 is an example of a drive section according to the present invention. Moreover, the left-right direction 9 is an example of a main scanning direction according to the present invention. Furthermore, the frontward-rearward direction 8 is an example of the secondary scanning direction according to the present invention.

As shown in FIG. 2, the platen 30 for holding, or in other words, for supporting the recording paper 21 flatly is provided at a position on a lower side the recording section 24, facing the recording section 24 sandwiching the transporting path 42. Nozzles which jet an ink are arranged in the recording head 29, to be lined up in a direction along the left-right direction 9 and the frontward-rearward direction 8. The recording head 29, while reciprocating in the left-right direction 9, jets from the nozzles an ink supplied from an ink cartridge (not shown in the diagram) on to the recording paper 21 which is transported on to the platen 30. Accordingly, an image is recorded on the recording paper 21 which is transported through the transporting path 42.

Moreover, a linear encoder 64 of an optical type (FIG. 5) is provided to the carriage 28 and the second carriage guide 52. The linear encoder 64 has a scale which is a reference of an amount of movement, and a reading head of an optical type which reads the scale. The reading head is installed on the carriage 28, and a scale is provided to the second carriage guide 52 along the left-right direction 9. The linear encoder 64 sends out a signal based on the movement of the carriage 28.

<Control Section 54>

The control section 54 is a microcomputer which includes a ROM (Read Only memory) in which various computer programs and data necessary for operation of the multi-function device 10 is stored, a RAM (Random Access Memory) which stores temporary data, and a CPU (Central Processing Unit) which executes upon loading a computer program from the ROM to the RAM. The control section 54 is functionally divided into a control section for a feeding motor (hereinafter, "feeding-motor control section") 76, a control section for a transporting motor (hereinafter, "transporting-motor control section") 77, a CR-motor control section 78, and an electromagnet control section 79.

The feeding-motor control section 76 controls the feeding motor 65 via a feeding-motor driving circuit 73. When an instruction for recording an image is given by a user, the feeding-motor control section 76 rotates the feeding motor 65 only by a predetermined amount. Rotation of the feeding motor 65 is transmitted to the paper feeding roller 25, and the recording paper 21 is supplied from the tray 20 to the transporting path 42. A rotary encoder 85 sends out a signal based on the rotation of the feeding motor 65. The control section 54 feeds back the signal which has been sent out by the rotary encoder 85, and uses it for a control by the feeding-motor control section 76.

The transporting-motor control section 77 controls the transporting motor 66 via a transporting-motor driving circuit 74. Rotation of the transporting motor 66 is transmitted to the first transporting roller 31, the second transporting motor 34, and the third transporting roller 37. The rotary encoder 53 sends out a signal based on the rotation of the transporting motor 66. The control section 54 feeds back the signal which has been sent out by the rotary encoder 53, and uses it for a control by the transporting-motor control section 77 and the CR-motor control section 78. Here, the transporting-motor control section 77, the transporting-motor driving circuit 74, the transporting motor 66, and the transporting rollers are an example of a transporting section according to the present invention.

The CR-motor control section 78 controls the CR motor 57 via a CR-motor driving circuit 75. The CR-motor control section 78 has a target command section 67 which determines a target value of a speed and an acceleration of the carriage 28. The target command section 67 has a speed command section which determines the speed of the carriage 28 and an acceleration command section 69 which determines the acceleration of the carriage 28.

The speed command section 68 determines a target speed of the carriage 28 at each point of time of image recording. For instance, the speed command section 68 stores a target speed trajectory which regulates the target speed at each point of time from a moment at which the carriage 28 starts moving till the carriage 28 stops, with the speed of the carriage 28 necessary for the recording head 29 to carry out jetting of ink for image recording, as a basis. Moreover, the speed command section 68 calculates the target speed at each point of time, based on the target speed trajectory. Similarly, the acceleration command section 69 stores a target acceleration trajectory which regulates the target acceleration at each point of time from a moment at which the carriage 28 starts moving till the carriage 28 stops. Moreover, the acceleration command section 69 calculates the target speed at each point of time, based on the target acceleration trajectory. The practical amount of movement, speed, and acceleration are detected by the control section 54 based on a signal sent out by the linear encoder 64. The CR-motor control section 78 carries out a feedback control of computing a control input of the CR motor 57 at each point of time such that, a deviation of a speed detected from the target speed, and a deviation of an acceleration detected from the target acceleration become zero. Moreover, the CR-motor control section 78 controls the CR motor 57 by supplying an electric current corresponding to the control input determined, to the CR motor 57 via the CR-motor driving circuit 75.

The electromagnet control section 79 controls an electric current which flows through the electromagnet 61, via the electromagnet driving circuit 62. An attraction of the first contact portion 58 with respect to the first carriage guide 51 changes according to a value of the electric current which flows through the electromagnet 61. A dynamic friction force between the first contact portion 58 and the first carriage guide 51 when the carriage 28 moves, changes by the attraction between the first contact portion 58 and the first carriage guide 51 being changed. Inclination of the carriage 28 while moving is prevented by controlling the dynamic friction force to an appropriate value. Details will be described later. The electromagnet control section 79, the electromagnet driving circuit 62, and the electromagnet 61 are an example of a friction-force adjusting section according to the present invention.

The control section 54 stores a target value of acceleration which the acceleration command section 69 determines, and a current trajectory (an example of an electric current profile according to the present invention), with which the value of the electric current flowing through the electromagnet 61 and a temperature which is judged from a temperature sensor 70 which will be described later are associated. The electromagnet control section 79 calculates the value of the electric current flowing through the electromagnet 61, based on the current trajectory. Calculation of the control input of the CR-motor control section 78 and calculation of the current value of the electromagnet control section 79 are carried out periodically after each predetermined period, as a series of controls. Therefore, determining the value of electric current to be supplied to the CR motor 57 and determining the value of electric current to be supplied to the electromagnet 61 are carried out consecutively almost at the same time.

<Temperature Sensor 70>

The temperature sensor 70 (an example of a sensor section according to the present invention) is provided in the area around the carriage 28. The temperature sensor 70 outputs a signal based on an ambient temperature of the printer section 11. The temperature sensor 70 is connected electrically to the electromagnet control section 79. A dynamic friction force between each contact portion and the carriage 28 fluctuates according to a temperature. The electromagnet control section 79 corrects the value of the electric current flowing through the electromagnet 61 based on the fluctuation of the dynamic friction force according to the temperature. The temperature sensor 70 may be provided to make a contact with the first carriage guide 51 or the second carriage guide 52, or may be installed on the carriage 28. Moreover, the temperature sensor 70 may be provided at a position away from the first carriage guide 51, the second carriage guide 52, and the carriage 28.

<Control of Movement of Carriage 28>

Figure 6B:
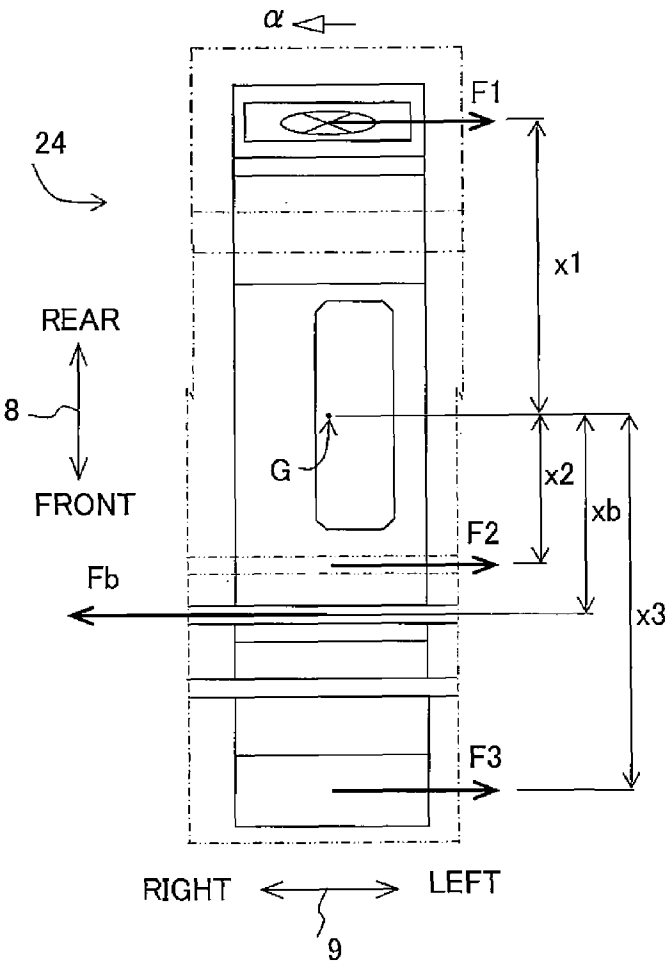
FIG. 6B is a diagram showing forces acting on the carriage at the time of acceleration of the carriage.
Figure 6A:
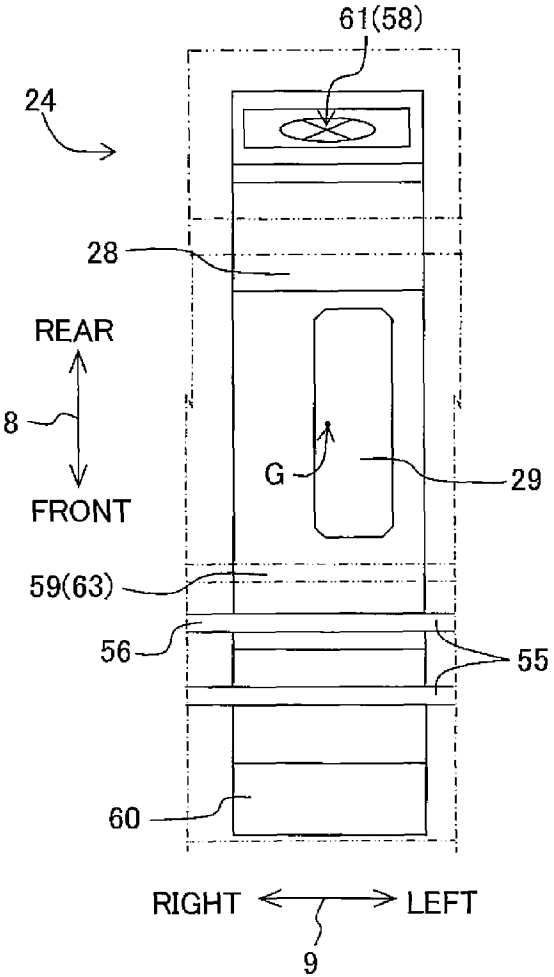
FIG. 6A is a diagram in which the carriage is viewed from a lower side.

A control which the electromagnet control section 79 carries out when the carriage 28 moves will be described below while referring to FIG. 6A and FIG. 6B. In FIG. 6A, G denotes a center of gravity of the carriage 28 in a state of the recording head 29 installed thereon. The center of gravity G is positioned on a nozzle surface 44 of the recording head 29, in which, the nozzles through which, the ink is jetted, are formed. FIG. 6B shows a state in which, the carriage 28 undergoes a uniformly accelerated motion with acceleration α in a rightward direction. Forces acting on the recording head 29 are shown by arrow marks.

Here, Fb denotes a driving force which the coupling portion 56 receives from the timing belt 55. F1 denotes a dynamic friction force which the first contact portion 58 receives from the first carriage guide 51. F2 denotes a dynamic friction force which the second contact portion 59 receives from the second carriage guide 52. F3 denotes a dynamic friction force which the third contact portion 60 receives from the second carriage guide 52. Moreover, each of xb, x1, x2, and x3 denotes a distance from the center of gravity G up to a point at which each force acts, in the frontward-rearward direction 8. The forces and the acceleration shown in FIG. 6B are positive values with respect to directions in which the arrow marks are directed. Here, the distances x1, x2, and x3 are examples of a first distance, a second distance, and a third distance respectively according to the present invention.

Here, a relational expression for the forces acting in the left-right direction 9 is indicated by the following expression.

<Relational Expression for Forces in FIG. 6B>

$$m\times\alpha=Fb-(F1+F2+F3)$$

For the carriage 28 not to be rotated on a plane along the frontward-rearward direction 8 and the left-right direction 9, it is necessary that a magnitude of a moment of the force having the center of gravity G as a center of rotation becomes zero. A relational expression based on the condition (hereinafter, let to be a relational expression for the moment of force) is as follows.

<Relational Expression for Moment of Force in FIG. 6B>

$$0=(Fb\times xb+F1\times x1)-(F2\times x2+F3\times x3)$$

When the two expressions mentioned above are solved to find F1 and Fb, we get the following result.

<F1 in FIG. 6B>

$$F1=(F2\times x2+F3\times x3-m\times\alpha\times xb-F2\times xb-F3\times xb)/(xb+x1)$$

<Fb in FIG. 6B>

$$Fb=(F2\times x2+F3\times x3+m\times\alpha\times x1+F2\times x1+F3\times x1)/(xb+x1)$$

Moreover, when the carriage 28 decelerates (a case in which a direction of the arrow mark of acceleration α is opposite to the direction in FIG. 6A) and when the carriage 28 is moving at a constant speed, a value of the dynamic friction force F1 for the magnitude of moment of the force having the center of gravity G as the center of rotation to become zero is as given below.

<Dynamic friction Force F1 when Carriage 28 is Decelerating>

$$F1=(F2\times x2+F3\times x3-m\times\alpha\times xb-F2\times xb-F3\times xb)/(xb+x1)$$

<Dynamic Friction Force F1 when Speed of Carriage 28 is Constant>

$$F1=(F2\times x2+F3\times x3-m\times\alpha\times xb-F2\times xb-F3\times xb)/(xb+x1)$$

According to the abovementioned description, in the dynamic friction force F1 at the time of deceleration of the carriage 28, a plus and a minus (a positive and a negative) of a term of acceleration α for the dynamic friction force at the time of acceleration of the carriage 28 is reversed. Moreover, in the dynamic friction force F1 at the time of movement at a constant speed of the carriage 28, the term of acceleration α is deleted from the dynamic friction force F1 at the time of acceleration of the carriage 28.

A relationship between the dynamic friction force F1 and an electric current I flowing through the electromagnet 61 will be described below. According to a formula for dynamic friction force, F1=μc×N. "μc" denotes a coefficient of dynamic friction between the first contact portion 58 and the first carriage guide 51. "N" denotes a force by which the first contact portion 58 and the first carriage guide 51 contact mutually, and N=Nb+Nm. Here, "Nb" denotes an attraction by the electromagnet 61 and "Nm" denotes a force acting by a weight of the carriage 28.

Moreover, according to a formula for attraction force of a magnet, $Nb=B^2\times S/(2\times\mu f)$. Here, "B" denotes a magnetic flux density by the electromagnet 61 and "μf" denotes a magnetic permeability of the first carriage guide 51. Moreover, B=μf×n×I, where, "n" denotes a winding number of a coil in the electromagnet 61, and the electric current I is an electric current which flows through the electromagnet 61. As it has been mentioned above, the value of the dynamic friction force F1 is as follows.

<Dynamic Friction Force F1 Based on Weight of Carriage 28 and Attraction Force of the Electromagnet 61>

$$F1=\mu c\times\mu f\times(n\times I)^2\times S/2+\mu c\times Nm$$

The value of the electric current I to be supplied to the electromagnet 61, which is necessary for achieving the dynamic friction force F1, is determined based on the abovementioned formula for F1 including the acceleration α. The acceleration trajectory which is the target value of the acceleration α of the carriage 28 being determined in advance, the current trajectory is also stored as a trajectory which regulates a value of electric current at each point of time, based on the acceleration trajectory. Moreover, since the coefficient of dynamic friction changes according to the temperature, the values of the dynamic friction forces F1, F2, and F3 also change. Consequently, the electromagnet control section 79 corrects the current trajectory by changing the values of the dynamic friction forces F1, F2, and F3, based on a signal from the temperature sensor 70. Based on the current trajectory which has been stored and corrected, the electromagnet control section 79 determines the value of the electric current to be supplied to the electromagnet 61 at each point of time, and supplies upon adjusting the electric current corresponding to the dynamic friction force F1, to the electromagnet 61 through the electromagnet driving circuit 62.

Figure 7:
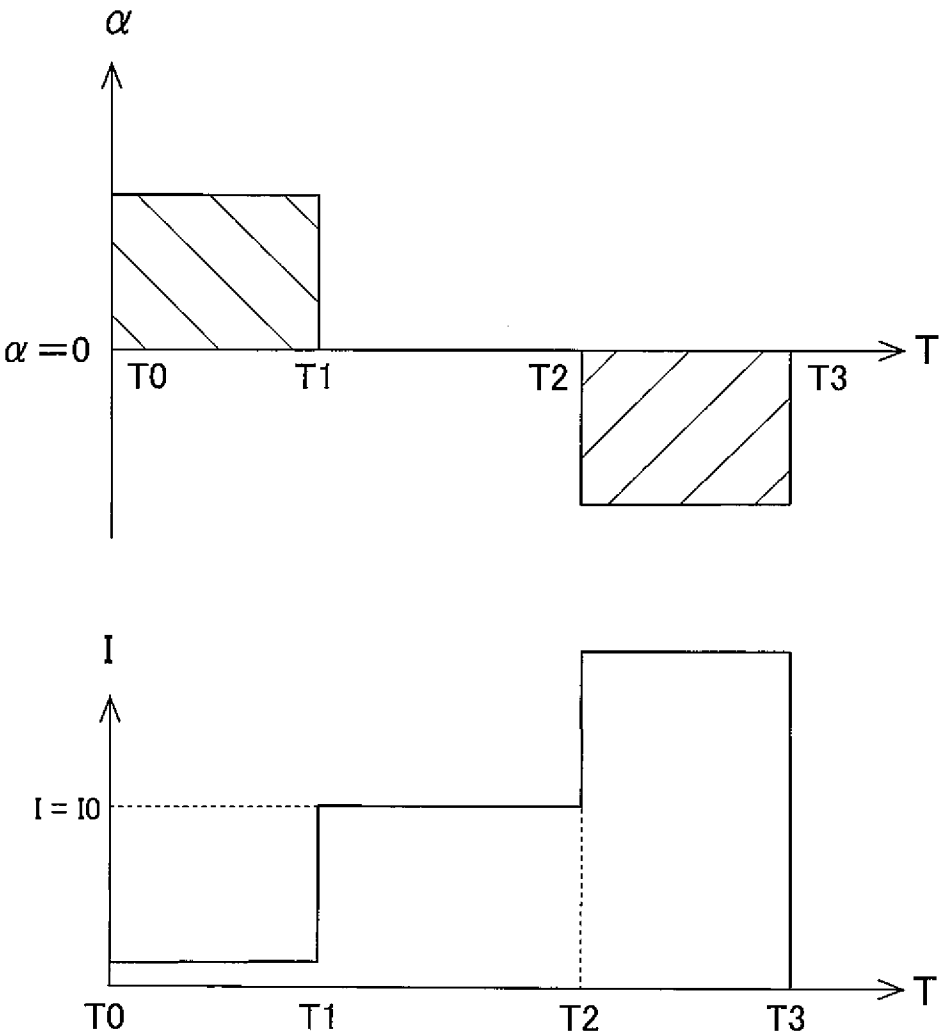
FIG. 7 shows an electric current which flows through an electromagnet when an acceleration of the carriage has changed with time.

FIG. 7 shows the acceleration of the carriage 28 at each point of time and the electric current I which the electromagnet control section 79 supplies to the electromagnet 61. During a time from T=T0 to T1, the carriage 28 undergoes a uniform accelerated motion toward a right side. In other words, during the time from T0 to T1, the carriage 28 is in a state of being accelerated in the main scanning direction. The electric current I at this time is smaller than a reference current I0. During a time from T=T1 to T2, the carriage 28 undergoes the uniformly accelerated motion in the main scanning direction. The electric current I at this time becomes same as the reference current I0. During a time from T=T2 to T3, the carriage 28 is in a state of being decelerated while moving in the main scanning direction. In other words, the force Fb by the timing belt 55 acts in a leftward direction. The electric current I at this time is higher than the reference current I0. In other words, letting the reference current I0 when the carriage 28 is in a state of moving at a constant speed as a standard, the electric current I decreases as the acceleration of the carriage 28 increases, and the electric current I increases as the acceleration of the carriage 28 decreases (as it increases in a direction of deceleration). However, when the carriage 28 has stopped, the electric current may not be supplied to the electromagnet 61.

[Action and Effect of Embodiment]

According to the embodiment, since the dynamic friction force acting between the first carriage guide 51 and the first contact portion 58 is adjusted almost at the same time as the driving force applied to the carriage 28 by the timing belt 55 changes, it is possible to prevent a generation of a rotational moment which changes a posture of the carriage 28.

Moreover, since the value of the electric current to be flowed in the electromagnet 61 is determined by referring to a table, from the temperature and the target value of acceleration of the carriage 28, the number of steps in the calculation by the electromagnetic control section 79 is reduced, and it is possible to suppress more promptly the generation of the rotational moment which changes the posture of the carriage 28.

Since the friction force and the coefficient of dynamic friction for each contact portion is corrected according to the temperature detected by the temperature sensor 70, it is possible to control the attraction force by the electromagnet 61 to an appropriate value.

Moreover, it is possible to realize an arrangement in which the friction force is changed by the electromagnet 61 at a low price, and the control of the dynamic friction force also becomes easy.

Since the appropriate value of the electric current which is to flow in the electromagnet is calculated easily based on various parameters, a change in a computer program of the control section associated with a change in specifications of an area around the carriage 28 is easy.

Moreover, in the embodiment, the arrangement has been made such that the contact portion which contacts with the carriage guide on both sides sandwiching the center of gravity G of the carriage 28 in the secondary scanning direction is disposed, and the dynamic friction force of the coupling portion 56 which sandwiches the center of gravity G between the coupling portion 56 of the carriage 28 is changed. Accordingly, in the state of acceleration of the carriage 28, the value of the electric current supplied to the electromagnet 61 becomes smaller than the value of the electric current in the state of moving at a constant speed, and in the state of deceleration of the carriage 28, the value of the electric current supplied to the electromagnet 61 becomes higher than the value of the electric current in the state of moving at a constant speed. Since the value of the electric current supplied to the CR motor 57 when the carriage 28 accelerates becomes high, with the small value of the electric current supplied to the electromagnet as in the abovementioned arrangement, a small voltage source capacity serves the purpose.

[First Modified Embodiment]

Figure 8A:
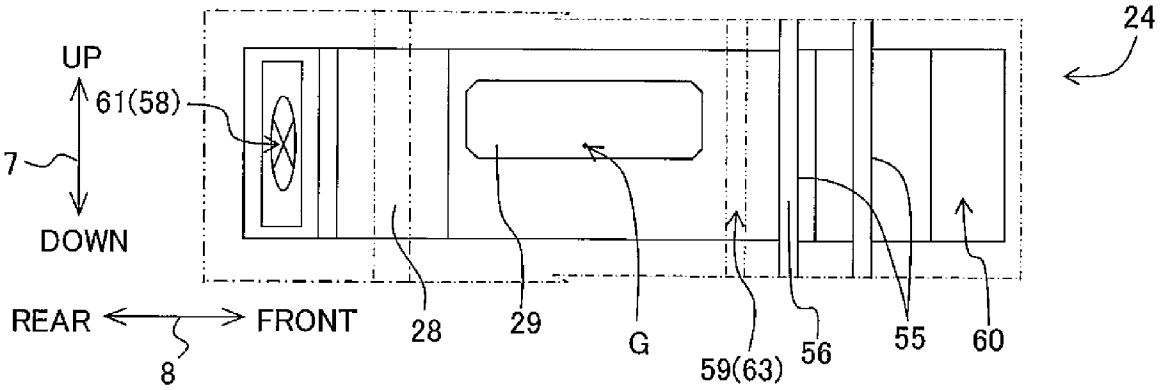
FIG. 8A is a diagram in which the carriage according to a first modified embodiment is viewed from a lower side.

A modified embodiment of the abovementioned embodiment will be described below while referring to FIG. 8A, FIG. 8B, and FIG. 9A to FIG. 9C. As shown in FIG. 8A, the carriage 28 may be a carriage which records an image on the recording paper 21 while reciprocating in the vertical direction 7, or in other words, in an upward and downward direction. In such an arrangement, the nozzles in the recording head 29 are directed in one of the left-right direction 9 (left side in an example in FIG. 8A). The recording paper 21 is transported frontward in a state of a front surface and a rear surface thereof along the vertical direction 7 and the frontward-rearward direction 8 respectively.

Figure 8B:
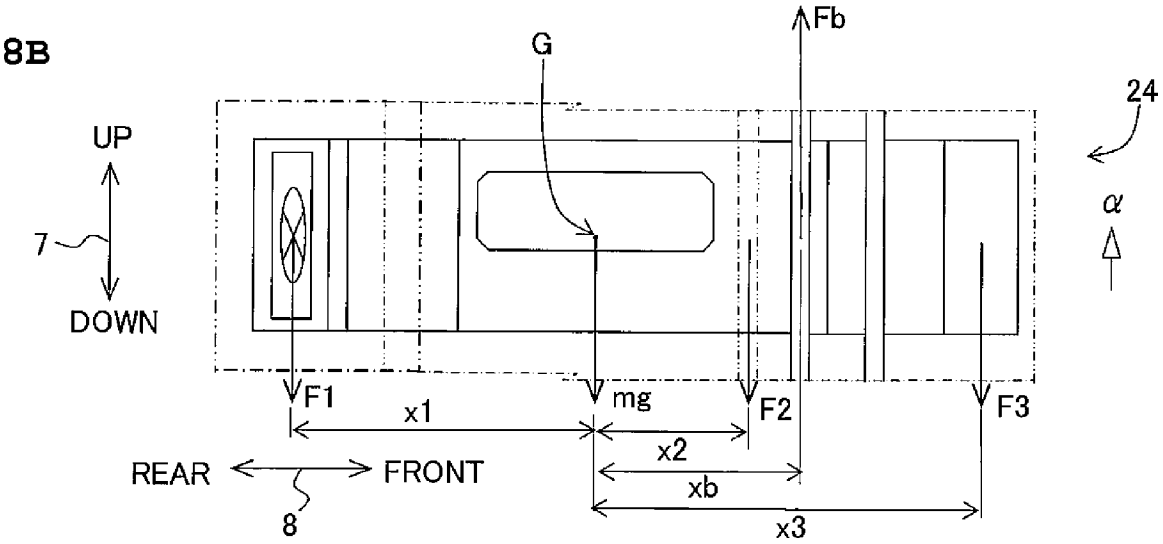
FIG. 8B is a diagram showing forces acting on the carriage when the carriage moves upward and accelerates.

In FIG. 8B, the dynamic friction forces Fb, F1, F2, and F3, and the distance xb, x1, x2, and x3 are defined similarly as in the abovementioned embodiment. However, in the modified embodiment, a force m×g acting downward from the center of gravity G by the weight of the carriage 28 is added. Here, "m" denotes a mass of the carriage 28, and "g" denotes a gravitational acceleration.

Here, a relational expression for a force in the vertical direction 9 is indicated by the following expression.

<Relational Expression for Force in FIG. 8B>

$$m\times\alpha=Fb-(F1+F2+F3+m\times g)$$

Moreover, a relational expression for a moment of force in which, rotation on a plane along the vertical direction 7 and the frontward-rearward direction 8 has been taken into consideration is as follows.

<Relational Expression for Moment of Force in FIG. 8B>

$$0=(Fb\times xb+F1\times x1)-(F2\times x2+F3\times x3)$$

When the two expressions mentioned above are solved to find F1 and Fb, we get the following result.

<Dynamic Friction Force F1 in FIG. 8B>

$$F1=(F2\times x2+F3\times x3-m\times\alpha\times xb-m\times g\times xb-F2\times xb-F3\times xb)/(xb+x1)$$

<Fb in FIG. 8B>

$$Fb=(F2\times x2+F3\times x3+m\times\alpha\times x1+m\times g\times x1+F2\times x1+F3\times x1)/(xb+x1)$$

Figure 9A:
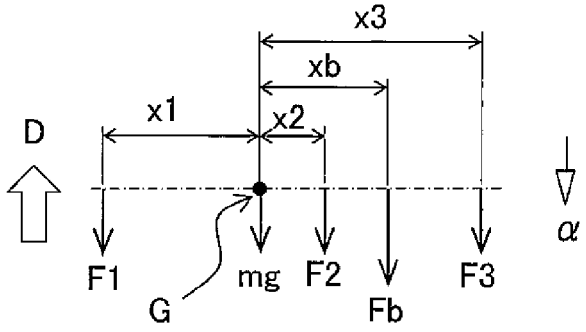
FIG. 9A, FIG. 9B, and FIG. 9C (hereinafter, "FIG. 9A to FIG. 9C") are diagrams showing forces which act on the carriage according to the first modified embodiment, where.
Figure 9B:
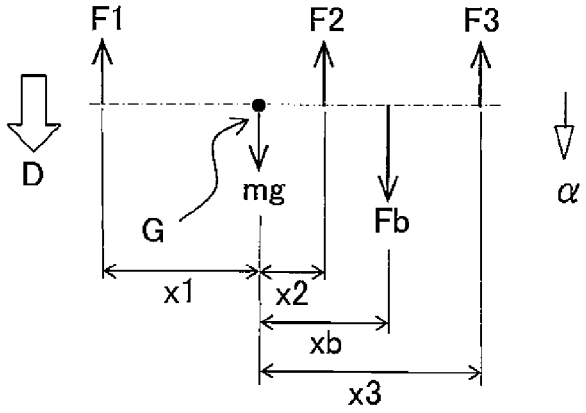
Figure 9C:
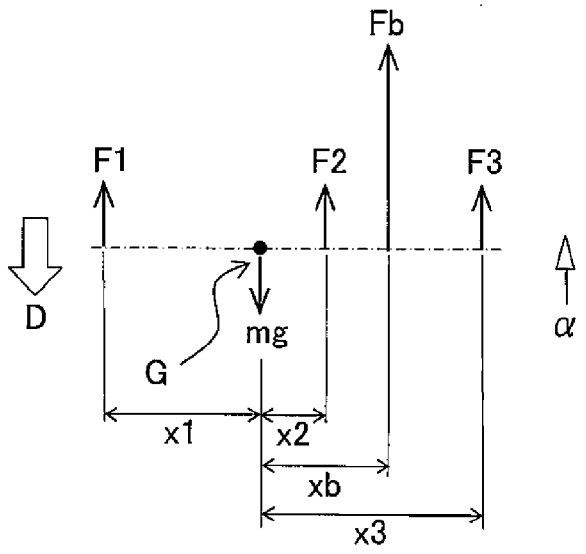

FIG. 9A shows a force acting on each portion when the carriage 28 moves upward and Fb is acting in a downward direction (when decelerating). FIG. 9B shows a force acting on each portion when the carriage 28 moves downward, and Fb is acting in the downward direction (when accelerating). FIG. 9C shows a force acting on each portion when the carriage 28 moves downward, and Fb is acting in the upward direction (when decelerating). Reference numeral D in FIG. 9A to FIG. 9C indicates the direction of movement of the carriage 28. A relational expression for force and a relational expression for the moment of force in the vertical direction in each situation are as follows.

<Relational Expression for Force in FIG. 9A>

$$-m\times\alpha=-Fb-F1-F2-F3-m\times g$$

<Relational Expression for Moment of Force in FIG. 9A>

$$0=F1\times x1-(Fb\times xb+F2\times x2+F3\times x3)$$

<Relational Expression for Force in FIG. 9B>

$$m\times\alpha=Fb+m\times g-(F1+F2+F3)$$

<Relational Expression for Moment of Force in FIG. 9B>

$$0=(Fb\times xb+F1\times x1)-(F2\times x2+F3\times x3)$$

<Relational Expression for Force in FIG. 9C>

$$-m\times\alpha=-Fb-F1-F2F3+m\times g$$

<Relational Expression for Moment of Force in FIG. 9C>

$$0=F1\times x1-(Fb\times xb+F2\times x2+F3\times x3)$$

It is possible to calculate each of the dynamic friction forces F1 and F2 from the relational expression for the moment and the relational expression for the moment of force in each situation. An aspect in which the electromagnet control section 79 supplies the value of the electric current corresponding to the dynamic friction force to the electromagnet 61 based on the target value of acceleration α and the abovementioned expression, and an aspect in which the CR motor control section 78 supplies the value of the electric current corresponding to Fb to the CR motor 57 based on the target value of acceleration α are similar as in the abovementioned embodiment.

[Second Modified Embodiment]

Figure 10A:
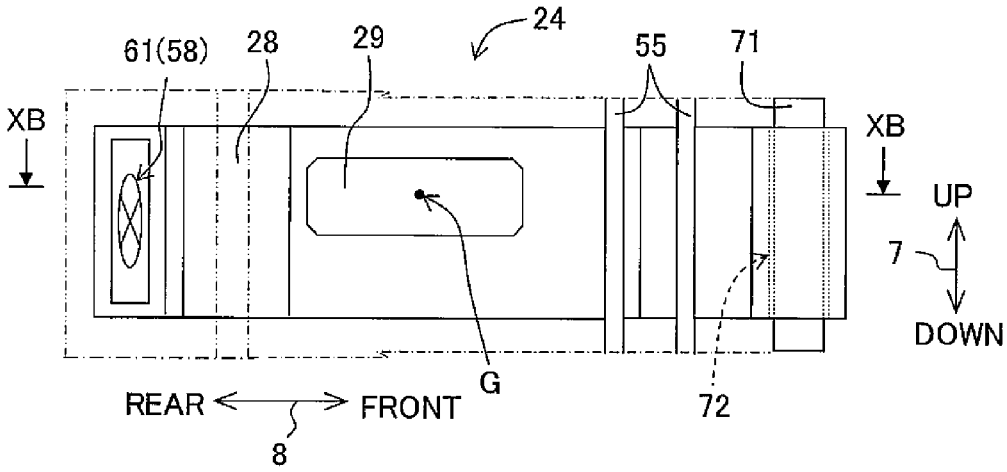
FIG. 10A is a diagram in which the carriage according to a second modified embodiment is viewed from a lower side.
Figure 10B:
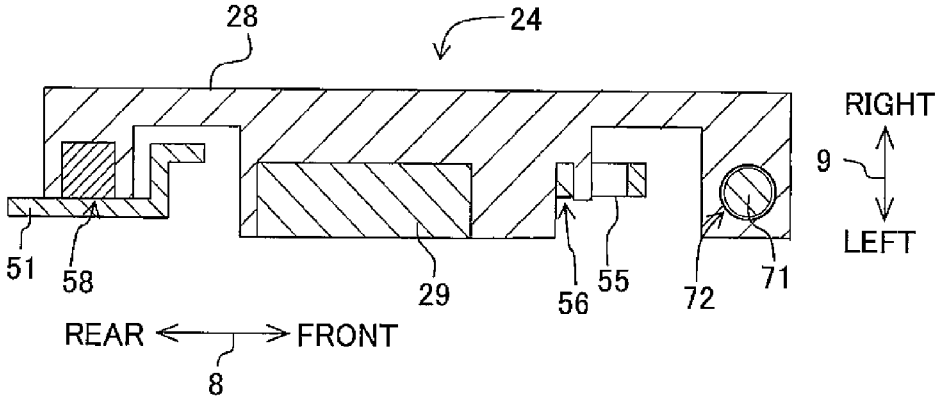
FIG. 10B is a cross-sectional view along a line XB-XB in FIG. 10A.

As shown in FIG. 10A and FIG. 10B, a shaft 71 may be used instead of the second carriage guide 52 as a member which supports the carriage 28. The shaft 71 is in the form of a rod which is extended along the vertical direction, and is surrounded by a supporting portion 72 (an example of a second contact portion according to the embodiment) of the carriage 28. The carriage 28 reciprocates in the vertical direction 9 similarly as in the abovementioned first modified embodiment. At that time, the supporting portion 72 slides with respect to an outer peripheral surface of the shaft 71.

Figure 10C:
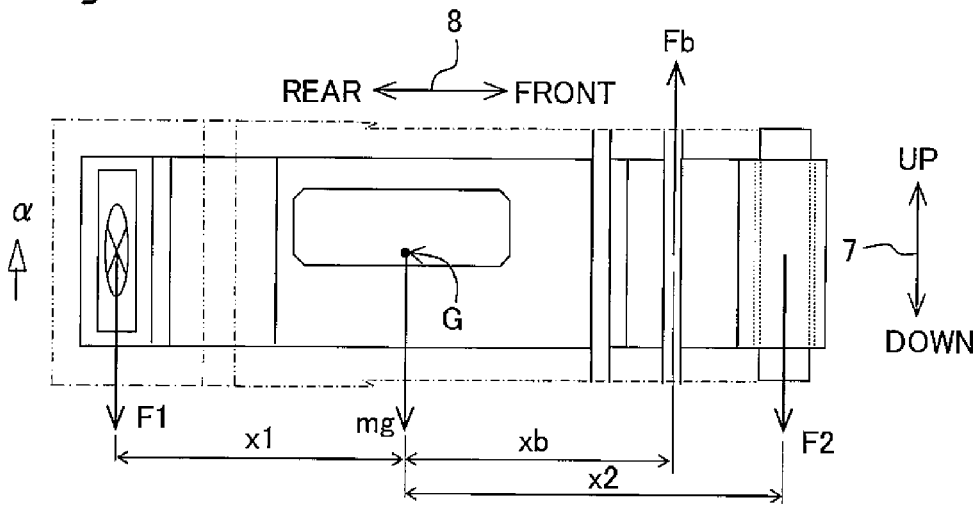
FIG. 10C is a diagram showing forces acting on the carriage when the carriage moves upward and accelerates.

FIG. 10C shows forces acting on each portion when the carriage 28 moves upward and Fb is acting in the upward direction (when accelerating). A dynamic friction force F2 is a dynamic friction force which the supporting portion 72 receives from the shaft 71. A relational expression for a force in the vertical direction 9 and a relational expression for moment of force in the vertical direction are as follow.

<Relational Expression for Force in FIG. 10C>

$$m\times\alpha=-Fb-F1-F2m\times g$$

<Relational Expression for Moment of Force in FIG. 10C>

$$0=F1\times x1-(Fb\times xb+F2\times x2)$$

It is possible to calculate each of the dynamic friction forces F1 and Fb from the relational expression for force and the relational expression for moment of force. In the second modified embodiment, sites at which, the carriage 28 receives the dynamic friction force are only two locations namely the first contact portion 58 and the supporting portion 72. Even in such an arrangement, it is possible to show an effect similar to the effect in the embodiment and the first modified embodiment described above.

[Other Modified Embodiments]

In the embodiment described above, for changing the dynamic friction force which the first contact portion 58 receives, the electromagnet 61 has been used. However, a method different from the abovementioned method may be used for changing the dynamic friction force. For instance, the first contact portion 58 be driven by a motor etc., and may have a contact member which is movable in a direction of pushing the first carriage guide 51. A force by which the contact member pushes the first carriage guide 51 may be controlled according to the acceleration of the carriage 28.

Or, the first contact portion 58 may have a sliding roller which is connected to a motor etc., and has a variable rotational resistance. The sliding roller rotates while sliding with respect to the first carriage guide 51 with the movement of the carriage 28. The rotational resistance of the sliding roller may be controlled in accordance with the acceleration of the carriage 28.

Or, in the future, when a material of which, the coefficient of friction is variable according to a voltage applied is developed, such a material may be used between the first contact portion 58 and the first carriage guide 51.

Moreover, in the embodiment and the modified embodiments described above, the carriage 28 contacts with the first carriage guide 51 and the second carriage guide 52 at a total of three locations. However, the carriage 28 may have four or more than four contact portions which contact with a member which guides the carriage. Moreover, as described in the second modified embodiment, there may be two contact portions sandwiching the center of gravity G of the carriage 28. There may be one independently controllable electromagnet 61 each, provided to each of the two contact portions sandwiching the center of gravity of the carriage 28. Moreover, the members guiding the carriage 28 are not necessarily required to be in plurality as the first carriage guide 51 and the second carriage guide 52.

The electromagnet control section 79 has stored the current trajectory at each point of time during the drive of the carriage 28 in advance, and has been using the current trajectory which has been determined based on the target acceleration trajectory which has been set in advance. However, the electromagnet control section 79 may determine the value of the electric current by using the acceleration of the carriage 28 in practical, and not the target acceleration. In other words, the arrangement may be made to be such that, the electromagnet control section 79 stores a current trajectory for which, a practical acceleration of the carriage 28 which is detected based on a signal from the linear encoder 64 is let to be a variable number, and the value of the electric current to be supplied to the electromagnet 61 is determined by inputting an acceleration which is detected for that current trajectory. However, determining the value of the current to be supplied to the electromagnet control section 79 based on the target acceleration trajectory is more effective for suppressing the inclination of the carriage 28.

What is claimed is:

1. An image recording apparatus configured to record an image on a sheet, comprising:

a carriage configured to move in a main scanning direction;

a recording head installed on the carriage and configured to record the image on the sheet;

a drive section having a motor and configured to apply a driving force to the carriage;

a guide member configured to guide the carriage in the main scanning direction;

a first contact portion provided to the carriage and configured to contact the guide member;

a second contact portion provided to sandwich a center of gravity of the carriage between the first contact portion and the second contact portion and configured to contact the guide member; and a friction-force adjusting section configured to adjust a dynamic friction force acting between the guide member and the first contact portion in accordance with an acceleration of the carriage.

2. The image recording apparatus according to claim 1, wherein the friction-force adjusting section is configured to adjust a pressure of the first contact portion to the guide member.

3. The image recording apparatus according to claim 2, wherein the friction-force adjusting section is configured to have an electromagnet which generates a magnetic force to attract mutually the guide member and the first contact portion, and is configured to adjust the pressure of the first contact portion to the guide member by changing the magnetic force.

4. The image recording apparatus according to claim 3, wherein the friction-force adjusting section is configured to store a current profile which indicates a value of an electric current to be supplied to the electromagnet during movement of the carriage in the main scanning direction, and the current profile is associated with an information which indicates a target value of an acceleration during movement of the carriage.

5. The image recording apparatus according to claim 4, wherein the friction-force adjusting section is configured to decrease the value of the electric current supplied to the electromagnet as the acceleration of the carriage increases.

6. The image recording apparatus according to claim 1, wherein the friction-force adjusting section is configured to adjust a dynamic friction force which acts between the guide member and the first contact portion based on an information which indicates a target value of an acceleration during movement of the carriage in the main scanning direction.

7. The image recording apparatus according to claim 1, wherein the carriage is configured to have a coupling portion which is coupled with the drive section, and the friction-force adjusting section is configured to adjust the dynamic friction force which acts between the guide member and the first contact portion based on at least:

a first distance from the center of gravity of the carriage up to the first contact portion in a secondary scanning direction which is orthogonal to the main scanning direction;

a second distance from the center of gravity of the carriage up to the second contact portion in the secondary scanning direction;

a third distance from the center of gravity of the carriage up to the coupling portion in the secondary scanning direction;

a friction force which acts between the second contact portion and the guide member;

a mass of the carriage on which the recording head has been installed; and an acceleration of the carriage.

8. The image recording apparatus according to claim 1, further comprising a sensor section configured to output a temperature signal based on a temperature around the guide member, wherein the friction-force adjusting section is configured to use a correction value of a coefficient of dynamic friction between the guide member and the first contact portion calculated from the temperature signal, for adjustment of the friction force which acts between the guide member and the first contact portion.

9. The image recording apparatus according to claim 8, wherein the friction-force adjusting section is configured to use a correction value of the dynamic friction between the guide member and the second contact portion calculated from the temperature signal, for the adjustment of the friction force which acts between the guide member and the first contact portion.

10. The image recording apparatus according to claim 1, wherein the guide member includes a first guide member extending in the main scanning direction and with which the first contact portion is configured to contact, and a second guide member extending in the main scanning direction and with which the second contact portion is configured to contact.

11. The image recording apparatus according to claim 1, wherein the main scanning direction is a vertical direction, and the friction-force adjusting section is configured to use gravity which acts on the carriage for adjustment of the dynamic friction force acting between the guide member and the first contact portion.

12. An image recording apparatus configured to record an image on a sheet, comprising:

a transporting section configured to transport the sheet along a transporting direction;

a carriage configured to move in a main scanning direction which intersects the transporting direction;

a recording head installed on the carriage and configured to record the image on the sheet which is transported by the transporting section;

a drive section having a motor and configured to apply a driving force to the carriage;

a guide member configured to guide the carriage in the main scanning direction; and a friction-force adjusting section configured to adjust a dynamic friction force between the carriage and the guide member, wherein the carriage is configured to have:

a coupling portion coupled with the drive section, a first contact portion provided to sandwich a center of gravity of the carriage between the coupling portion and the first contact portion, and configured to contact the guide member under a condition that the carriage moves, and a second contact portion provided on a side of the coupling portion in the transporting direction with respect to the center of gravity, and configured to contact the guide member under the condition that the carriage moves, wherein the friction-force adjusting section is configured to have an electromagnet which generates a magnetic force to attract mutually the guide member and the first contact portion, and to adjust a value of an electric current to be supplied to the electromagnet in accordance with an acceleration of the carriage.

13. The image recording apparatus according to claim 12, wherein the guide member includes a first guide member extending in the main scanning direction and with which the first contact portion is configured to contact, and a second guide member extending in the main scanning direction and with which the second contact portion is configured to contact.

14. The image recording apparatus according to claim 12, wherein the friction-force adjusting section is configured to decrease the value of the electric current supplied to the electromagnet as the acceleration of the carriage increases.

* * * * *